US006119387A

United States Patent [19]

Butters et al.

[11] Patent Number: 6,119,387

[45] Date of Patent: Sep. 19, 2000

[54] TRIGGER SAFETY MECHANISM

[76] Inventors: John T. Butters, HC-1, Box 923-34, Center Point, Tex. 78010; Henry J. Belk, 4592-B River Rd., Buhl, Id. 83316

[21] Appl. No.: 09/075,201

[22] Filed: May 11, 1998

[51] Int. Cl.[7] ..... F41A 17/00

[52] U.S. Cl. ..... 42/70.08

[58] Field of Search ..... 42/70.08, 70.04, 42/70.05

[56] References Cited

U.S. PATENT DOCUMENTS

| | | | |
|---|---|---|---|
| 3,949,508 | 4/1976 | Elkas | 42/69.03 |
| 4,305,218 | 12/1981 | Godsey | 42/70.08 |
| 4,833,811 | 5/1989 | Wilkinson | 42/70.08 |
| 4,989,357 | 2/1991 | Norman et al. | 42/70.08 |
| 5,067,266 | 11/1991 | Findlay | 42/70.08 |
| 5,247,757 | 9/1993 | Deeb | 42/70.08 |
| 5,335,437 | 8/1994 | Anderson | 42/70.08 |
| 5,560,132 | 10/1996 | Merlino | 42/66 |
| 5,697,178 | 12/1997 | Haskell | 42/70.04 |
| 5,881,485 | 3/1999 | Milazzo | 42/70.08 |

FOREIGN PATENT DOCUMENTS

| | | |
|---|---|---|
| 660046 | 10/1948 | United Kingdom . |
| 2 144 525 | 3/1985 | United Kingdom . |

*Primary Examiner*—Charles T. Jordan
*Assistant Examiner*—Jeffrey Howell
*Attorney, Agent, or Firm*—Richard C. Litman

[57] ABSTRACT

A safety mechanism for rifles and shot guns in which hammer movement to strike the firing pin is prevented unless the trigger is pulled, thereby precluding inadvertent discharge. The safety mechanism is retrofittable into the population of rifles and shotguns utilizing the Remington Common Fire Control System (RCFCS) and with suitable dimensional adaptation into others, and includes an interceptor designed to engage the hammer and prevent movement thereof if the sear and hammer should become disengaged for any reason other than manipulation of the trigger.

8 Claims, 4 Drawing Sheets

TRIGGER SAFETY MECHANISM

BACKGROUND OF THE INVENTION

1. Field of the Invention

The present invention relates to firearms, and more specifically to a safety mechanism that prevents an inadvertent discharge of a firearm in the absence of actuation of the trigger.

2. Description of the Related Art

Inadvertent discharge of firearms of the long arm variety (rifles and shotguns) in the absence of a trigger pull has been the source of numerous accidental deaths, injuries, and property damage. Malfunction of the normal means of restraint of the hammer or striker by the searing mechanism has long been recognized as the leading factor permitting these accidents to occur.

While numerous prior art patents disclose safety devices to prevent accidental discharge of firearms, none is believed to show a fully passive automatic safety system for long arms which will perform its safety function in the absence of any active involvement by the firearm's user. For example, U.S. Pat. No. 3,949,508 (Elkas), U.S. Pat. No. 4,833,811 (Wilkinson), and U.S. Pat. No. 5,335,437 (Anderson) disclose firearm safety devices which must be positively activated by the user. U.S. Pat. No. 5,067,266 (Findlay) discloses a lever action rifle including a safety device which requires a trigger latching mechanism. U.S. Pat. No. 5,247,757 (Deeb) discloses a hammerless firearm safety arrangement. U.S. Pat. No. 5,697,178 (Haskell) discloses a linkage with a safety button for blocking a trigger, sear, and hammer. Patent 660,046 (Great Britain) shows a safety catch for a firing pin. Patent 2,144,525 (Great Britain) shows a safety device wherein an enclosed hammer is locked in an intermediate position.

None of the above inventions and patents, taken either singularly or in combination, is seen to disclose a passive automatic safety mechanism as described and claimed in the instant invention. Thus, a trigger safety mechanism for long arms solving the aforementioned problems is desired.

SUMMARY OF THE INVENTION

The present invention describes a safety mechanism for firearms and especially for rifles and shotguns that use the Remington Common Fire Control System (RCFCS). The safety mechanism ensures that the firearm's hammer will not be released unless the trigger is moved far enough (effective rearward manipulation) to release the safety mechanism. Thus, accidental jarring or striking of the firearm will not cause inadvertent discharge. The safety mechanism requires five small parts which are easily retrofitted into longarms of the RCFCS type. The five parts include an interceptor device made of sheet metal, a torsion spring, a flat-topped wear button, and two common washers. The invention also requires that a second hook is formed in the firearm's hammer and that a shelf is milled in the trigger housing. The interceptor is mounted alongside the firearm's sear, trigger, and hammer and is spring loaded to automatically engage the aforementioned second hook formed in the hammer. This automatic engagement prevents the hammer from being released if the sear becomes accidently disconnected from the hammer.

Accordingly, it is a principal object of the invention to provide a safety mechanism for a firearm of the long arm type that is effective in preventing inadvertent discharge.

It is a another object of the invention to provide a safety mechanism for a firearm of the long arm type that blocks firing movement unless the trigger is pulled.

It is a further object of the -invention to provide a safety mechanism for a firearm of the long arm type wherein the hammer is automatically engaged to prevent inadvertent discharge.

Still another object of the invention is to provide a safety mechanism for a firearm of the long arm type that is easily and economically retrofittable to a large population of existing firearms with separate sear and hammer mounted on a common trigger mounting plate.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
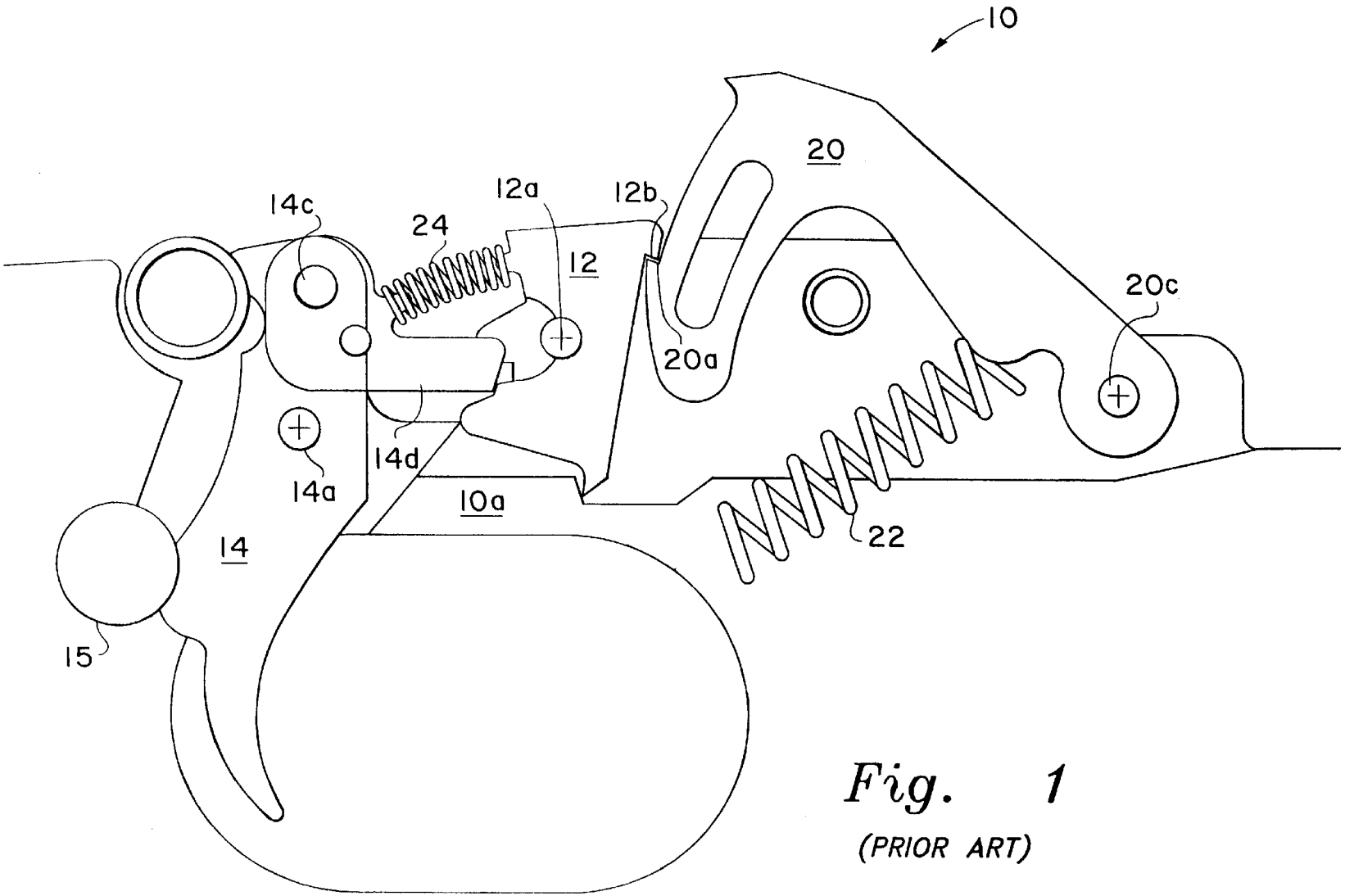
Fig. 1 (PRIOR ART)
FIG. 1 is a partial right side elevational view of a typical trigger assembly utilized in a RCFCS (prior art).
Figure 2:
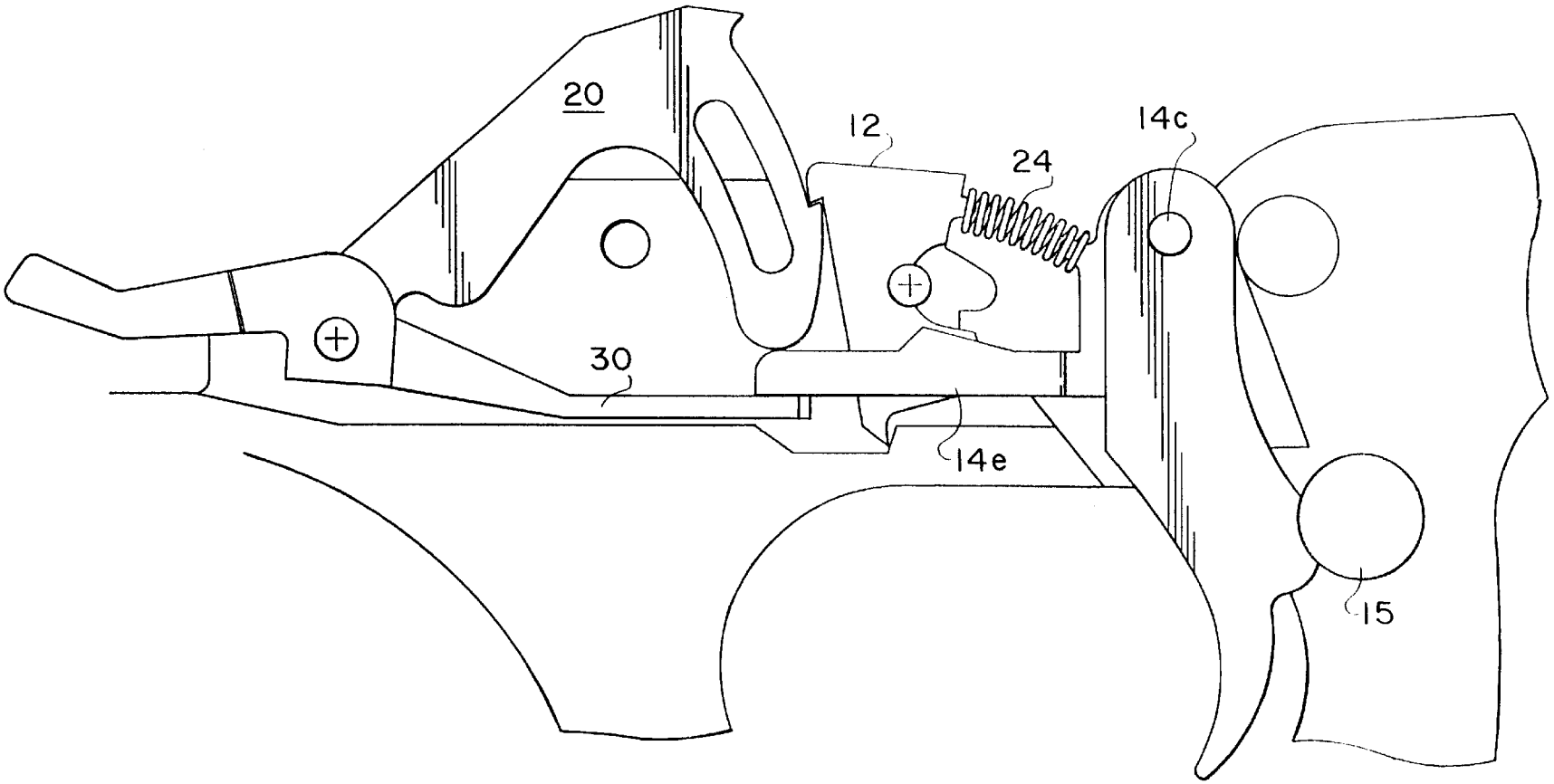
Fig. 2 (PRIOR ART)
FIG. 2 is a partial left side elevational view of a typical trigger assembly utilized in a RCFCS (prior art).

FIGS. 1 and 2, of the drawing, illustrate a trigger assembly 10 utilized in long firearms such as rifles and shotguns and mounted in housing 10*a*. The art designation for assembly 10 is the Remington Common Fire Control System (RCFCS). The RCFCS requires a sear 12 separate and independent from trigger 14. Sear 12 is mounted for rotation around pivot pin 12*a* and incorporates a notch 12*b* for engaging a hook portion 20*a* formed on a hammer 20 which hammer is rotatably mounted on pivot pin 20*c*. As shown in FIG. 1, sear 12 holds hammer 20 in a cocked position against the force of a hammer spring 22. Trigger-sear spring 24 biases sear 12 into engagement with hammer 20. Trigger 14 is mounted for rotation about pivot pin 14*a*. A cross bolt safety is indicated at 15. The function of a cross bolt safety device is well known in the art and such device forms no part of the present invention. A connector assembly, comprising a right connector arm 14*d* and a left connector arm 14*e*, is pivotably attached to trigger 14 at 14*c*. Right connector arm 14*d* engages sear 12 and functions to cause the sear to rotate and disengage from hammer 20 when the trigger 14 is pulled. As shown in FIG. 2, a disconnector 30 is positioned to abut left connector arm 14*e* and to push left connector arm upwardly when the trigger is pulled and hammer 20 moves to strike a firing pin (not shown) as known in the art.

Figure 3:
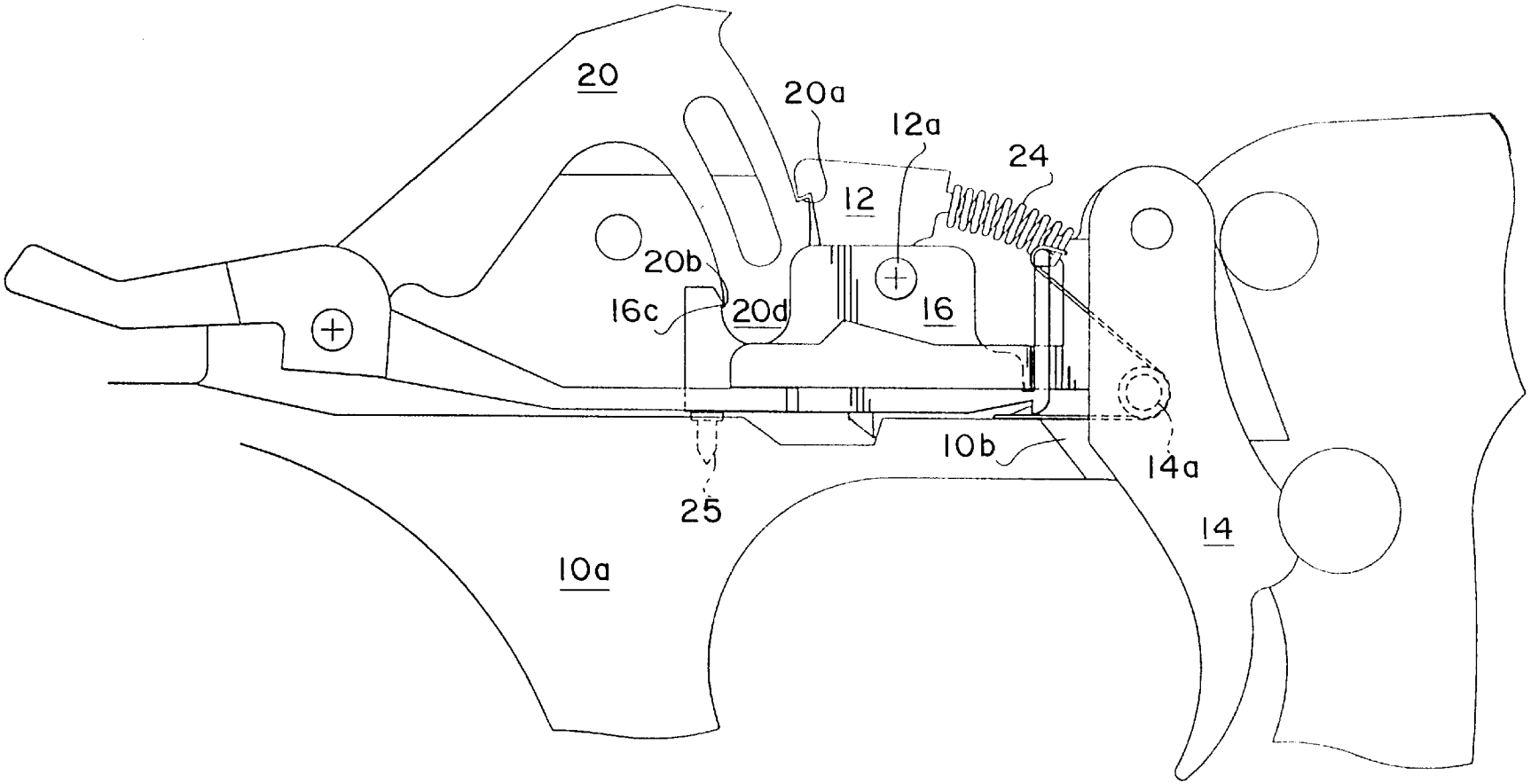
FIG. 3 is a partial left side elevational view of a typical trigger assembly utilized in a RCFCS incorporating the present invention.
Figure 4:
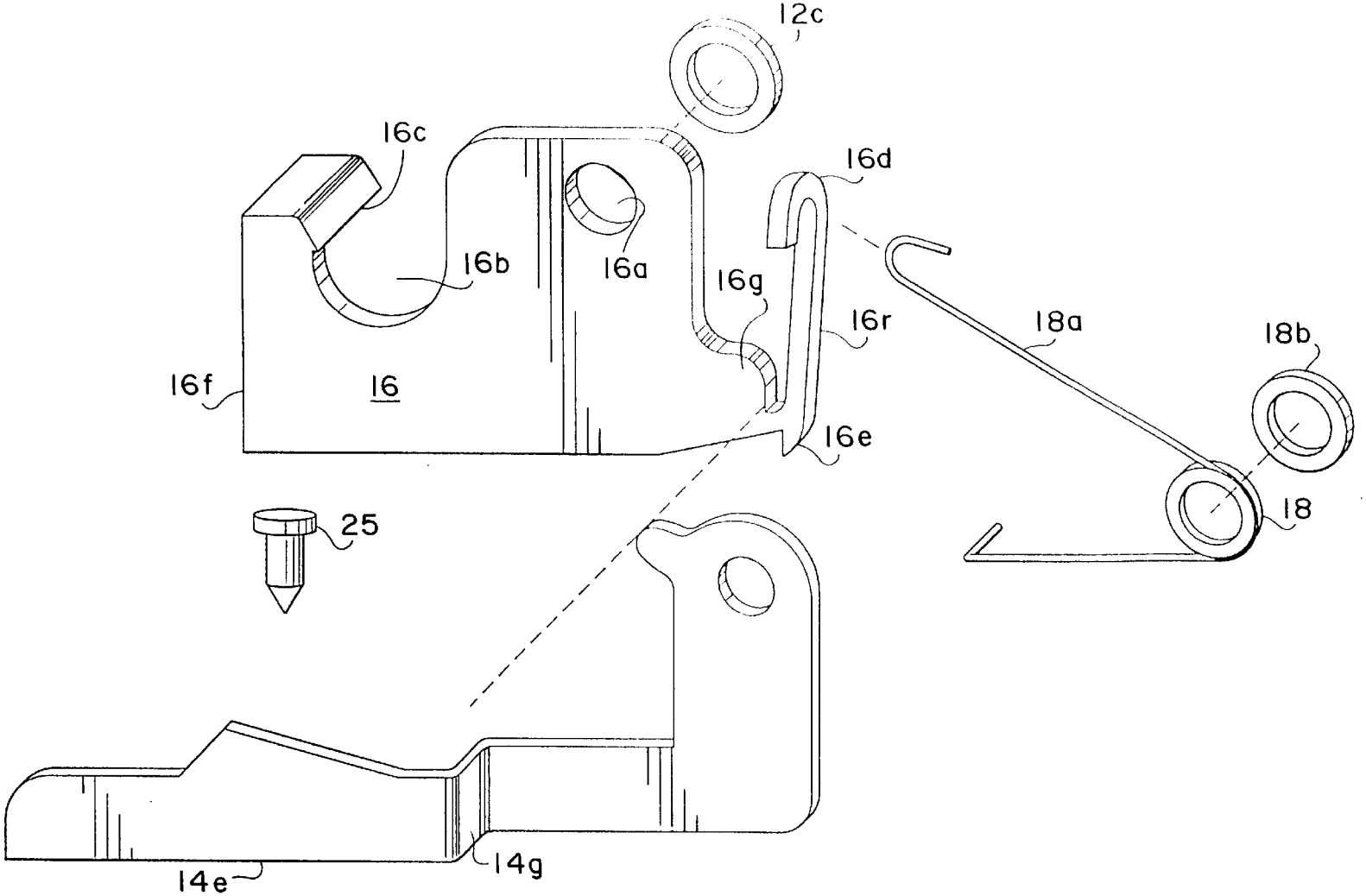
FIG. 4 is an exploded view of the safety mechanism of the present invention.

The present invention, as illustrated in FIGS. 3 and 4, comprises a safety mechanism retrofitted to the assembly shown in FIGS. 1 and 2. The safety mechanism includes a sheet metal interceptor 16 slidably mounted in the left center of the trigger housing 10*a*. Interceptor 16 is held in position by a trigger plate casting on the left (not shown) and sear 12 and hammer 20 on the right. A slotted hole 16*a*, formed in interceptor 16, receives sear pivot pin 12*a*. To reduce wear and friction, a washer 12*c* is positioned on pivot pin 12*a* between interceptor 16 and sear 12. Interceptor 16 has an opening 16*b* formed adjacent a front end 16*f* to receive a head 20*d* of hammer 20. A second hook portion 20*b* is formed on hammer 20 and is adapted to engage a hook 16*c* fashioned on interceptor 16. A rear end 16r of interceptor 16 is bent at 16*d* to receive and hold a leg 18*a* of a torsion spring 18. Torsion spring 18 is positioned on pivot pin 14*a*. Torsion spring 18 and trigger 14 are interposed by a spacer washer 18*b*. A flat topped button 25, pressed into trigger assembly housing 10, is positioned for sliding engagement with interceptor 16 to reduce wear. Button 25 should be of a proper hardness to prevent galling under impact and friction. A heel 16*e* is formed on interceptor 16 at a lower portion of rear end 16*r*. Heel 16*e* is adapted to engage a shelf 10*b* milled into trigger housing 10*a* as will be later explained. As most clearly shown in FIG. 4, interceptor 16 is designed to have a (curved portion 16*fg* adjacent rear end 16*r*. Interceptor 16 is installed in housing 10 such that an elbow 14*g* of connector arm 14e will abut curved portion 16*f* when the firearm is in a cocked position.

In operation, interceptor 16 is urged to the rear by torsion spring 18. When the gun is cocked, the head 20*d* of hammer 20 enters opening 16*b* and cams interceptor 16 forward (away from the trigger) against the action of torsion spring 18. Hammer 20 is forced downward past the point of engagement with sear 12 and interceptor 16. As spring 22 attempts to move the hammer forward, sear notch 12*b* and interceptor hook 16*c* are in position to engage hammer hook portions 20*a* and 20*b* respectively to prevent forward movement. In normal operation the sear will make the initial engagement with the hammer and hold the hammer in cocked position. With safety 15 disengaged, manual pulling of trigger 14 moves connectors 14*d*,14*e* and consequently elbow 14*g* forwardly. Since elbow 14*g* abuts curved portion 16*f*, interceptor 16 will be forced forwardly against the action of spring 18. Thus, possible engagement of interceptor hook 16*c* and hammer hook 20*b* is eliminated. Simultaneously, normal rotation of the sear by action of the right connector 14*d* will occur and the hammer is allowed to move forwardly. As noted above, in normal operation disconnector 30 will push left connector arm 14*e* upwardly such that elbow 14*g* will be out of engagement with interceptor 16 thus, allowing the interceptor to return to a position to reengage the hammer in the next cocking cycle.

If for any reason the sear becomes dislodged from the hammer without the trigger being pulled, the interceptor is in position to catch the hammer via engagement of hooks 16*c* and 20*b*. Upon such engagement, action of hammer spring 22 will tend to rotate the interceptor's rear portion downward and out of contact with elbow 14*g*. Downward rotation of the rear portion will also cause heel 16*e* to engage shelf 10*b*, thus preventing any further motion of interceptor 16. Upon recocking, the cycle will start again.

It is to be understood that the present invention is not limited to the embodiment described above, but encompasses any and all embodiments within the scope of the following claims.

We claim:

1. A safety mechanism for a gun comprising:

a trigger assembly housing incorporating, in horizontal alignment, a trigger, a sear, and a pivotal hammer having a head and a first hook formed thereon, said sear having a notch engageable with said first hook formed on said head of said hammer for retaining said hammer in a cocked position;

a connector assembly pivotably mounted on said trigger, said connector assembly including a right connector arm and a left connector arm, wherein said right connector arm abuts said sear and said left connector arm is positioned beside and spaced from said sear and said hammer; and safety means slidably mounted in said trigger assembly housing and positioned in the space defined between said left connector arm and said sear and said hammer, said safety means preventing the release of said hammer to fire said gun in the absence of trigger actuation;

wherein said safety means includes a sheet metal member having a front end and a rear end, a torsion spring mounted adjacent said trigger, said torsion spring having a leg attached to said rear end of said sheet metal member, said sheet metal member being biased toward said trigger; and wherein said sheet metal member has a curved portion adjacent said rear end thereof, and wherein said left connector arm forms an elbow which abuts said curved portion, whereby said elbow urges said sheet metal member in a direction away from said trigger upon actuation of said trigger.

2. A safety mechanism for a gun as defined in claim 1, wherein said sheet metal member has an opening formed at said front end for receiving said head of said hammer.

3. A safety mechanism for a gun as defined in claim 2, wherein said head of said hammer has a second hook formed thereon, and said sheet metal member has a hook formed at an edge of said opening for engaging said second hook, whereby movement of said hammer is prevented.

4. A safety mechanism for a gun as defined in claim 3, wherein said trigger assembly housing includes a wear button pressed therein, said wear button being dimensioned and positioned to be in sliding contact with said sheet metal member.

5. A safety mechanism for a gun as defined in claim 4, further comprising a first pivot pin disposed through said sear, wherein said sear is pivotable about said first pivot pin disposed therethrough, said sheet metal member having a slot formed therein to receive said first pivot pin, there further being a first washer, wherein said sear and said sheet metal member are interposed by said first washer, which is mounted on said first pivot pin.

6. A safety mechanism for a gun as defined in claim 5, further comprising a second pivot pin disposed through said trigger, wherein said trigger is pivotable about said second pivot pin disposed therethrough, said torsion spring being positioned on said second pivot pin, there further being a second washer, wherein said trigger and said torsion spring are interposed by said second washer mounted on said second pivot pin.

7. A safety mechanism for a gun as defined in claim 6 wherein said trigger housing assembly has a shelf formed therein adjacent said rear end of said sheet metal member.

8. A safety mechanism for a gun as defined in claim 7 wherein said sheet metal member has a heel portion formed on said rear end, said heel portion being configured and dimensioned to engage said shelf when said safety means prevents release of said hammer.

* * * * *